United States Patent [19]

Aaron

[11] 4,214,525

[45] Jul. 29, 1980

[54] BELT-TYPE PRINTING MACHINE WITH SERPENTINE BELT SUPPORT

[75] Inventor: Charles Aaron, West Caldwell, N.J.

[73] Assignee: Midland-Ross Corporation, Cleveland, Ohio

[21] Appl. No.: 960,220

[22] Filed: Nov. 13, 1978

Related U.S. Application Data

[63] Continuation of Ser. No. 836,130, Sep. 23, 1977, abandoned, which is a continuation of Ser. No. 679,930, Apr. 26, 1976, abandoned.

[51] Int. Cl.[3] ..... B41F 5/06; B41F 5/16; B41F 17/02

[52] U.S. Cl. ..... 101/181; 101/219; 101/DIG. 27

[58] Field of Search ..... 101/212, 219, 171, 181, 101/178, 141, 175, 176, 220, 221, 222, 223, 225

[56] References Cited

U.S. PATENT DOCUMENTS

| | | | |
|---|---|---|---|
| 881,167 | 3/1908 | Thomas | 101/181 X |
| 2,013,738 | 9/1935 | Wolcott | 101/150 |
| 2,031,063 | 2/1936 | Pesci | 101/181 |
| 2,037,181 | 4/1936 | Shomaker | 101/174 X |
| 2,661,687 | 12/1953 | Chance | 101/367 X |
| 2,788,738 | 4/1957 | Wood | 101/171 |
| 2,930,318 | 3/1960 | Stroud | 101/223 |
| 3,345,944 | 10/1967 | Simmons | 101/426 |
| 3,518,940 | 7/1970 | Stroud et al. | 101/223 |

FOREIGN PATENT DOCUMENTS

| | | | |
|---|---|---|---|
| 1204239 | 11/1965 | Fed. Rep. of Germany | 101/219 |

*Primary Examiner*—J. Reed Fisher
*Attorney, Agent, or Firm*—Harian E. Hummer

[57] ABSTRACT

Disclosed is a printing machine incorporating a compact serpentine arrangement for supporting one or more printing belts in printing relation with a path for a printable web. The belt support arrangement herein disclosed has great utilizing in a belt printing machine wherein a plurality of belts are required in the printing of a single web to not only conserve space but to render equipment at the printing stations more accessible, and to enable the envelopment of a large portion of the periphery of each plate cylinder by the associated belt passing therearound.

4 Claims, 6 Drawing Figures

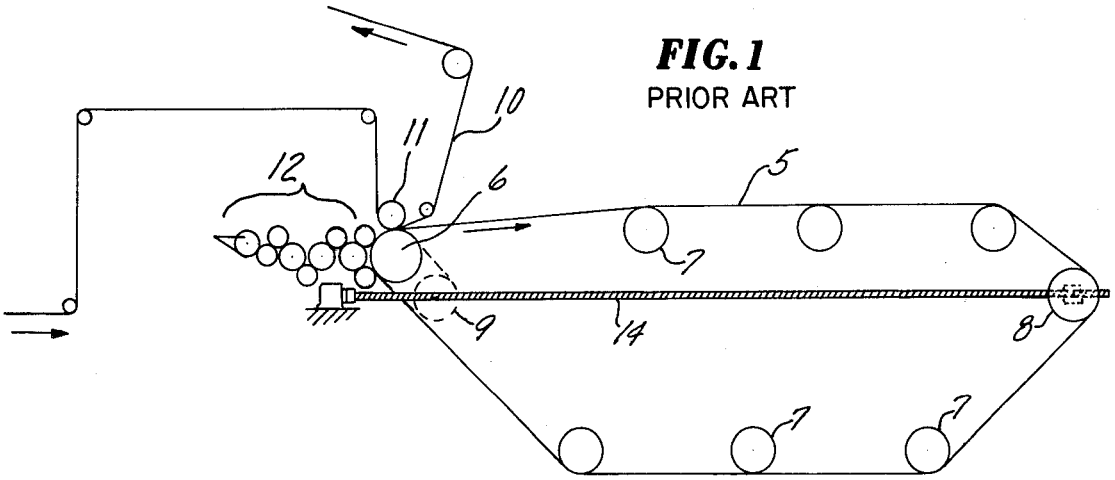
FIG. 1
PRIOR ART
FIG. 2
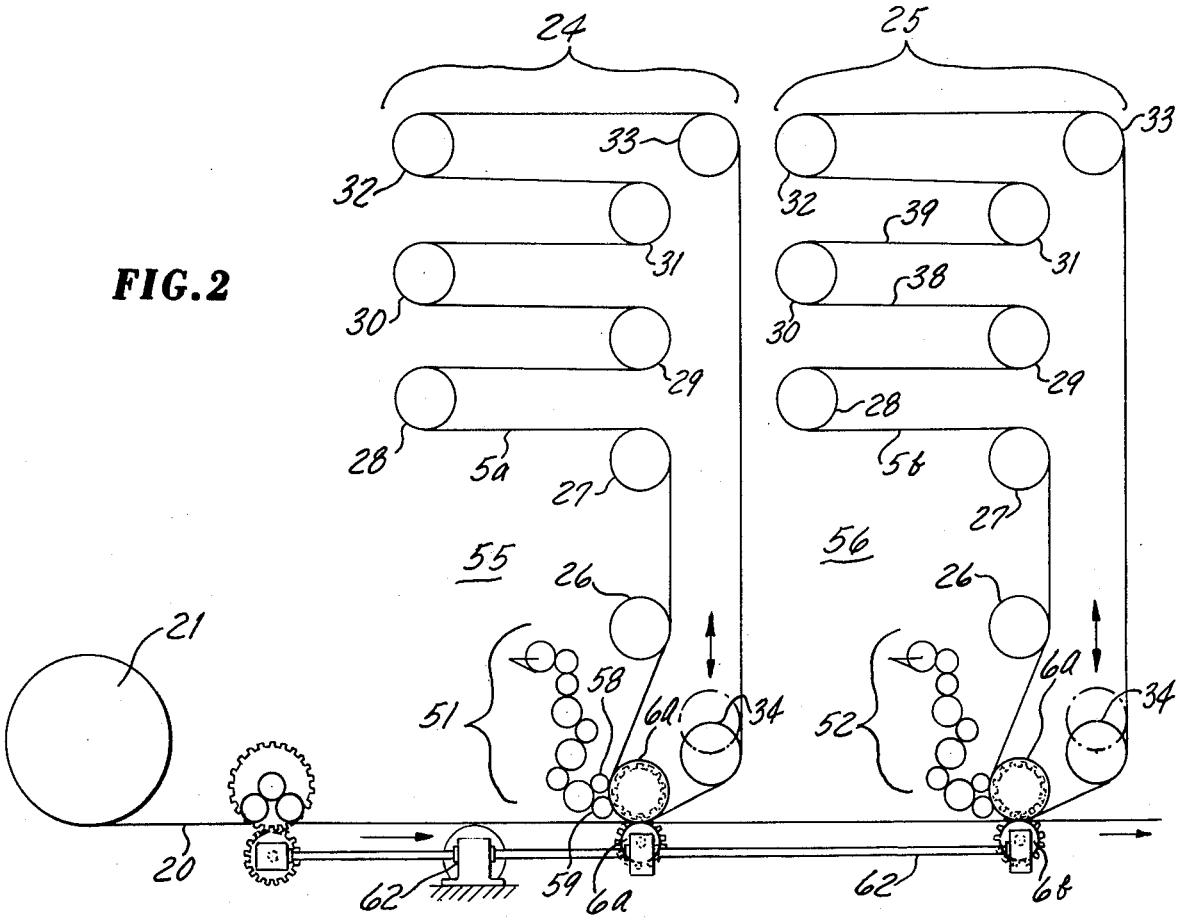

BELT-TYPE PRINTING MACHINE WITH SERPENTINE BELT SUPPORT

Cross Reference to Related Applications

This application is a continuation of application Ser. No. 836,130 filed Sept. 23, 1977, now abandoned, which is a continuation of Application Ser. No. 679,930 filed Apr. 26, 1976, now abandoned.

Background of the Invention

In the production of books by a belt-type printing machine, such as disclosed in Stroud et al U.S. Pat. No. 3,518,940, an essential requirement is that the printing-belt support structure shall be constructed so as to be adjustable to maintain in taut condition any one of a variety of belts whose lengths vary from, e.g., 5 feet to 75 feet in accordance with the number of pages in books to be printed. The above-noted patent discloses support structure defining a generally ovate belt circuit which has served well in the commercial use of single belt machines. However, the machine typified in this patent is being adapted to uses, such as multicolor printing, which require engaging a single printable web with two or more printing belts. To provide belt-supporting structure according to the above-noted patent for a multiple belt machine requires individual belt-support systems, each perhaps 30 feet in length, stacked either vertically or horizontally with great consumption of shop space requiring perhaps special building construction. Furthermore, there is the problem of providing good machine arrangement in the vicinity of the plate roll and the impression roll for each belt for the mounting of ink trains and other equipment, and adequate space for operators to service the equipment.

There arises also the need for machine design in which printing stations may be established progressively along the web path in close consecutive proximity with each other, perhaps no more than about 6 feet apart. Minimum distance between printing stations is desired to avoid such distortion in the length to the web as to affect accuracy of color registration.

Another important aspect in the storage of rapidly moving belts during the printing operation is the possibility of lateral vibration or whipping especially when substantial sections of the belt must be oriented in a vertical direction.

Hence, objects of the invention are to provide improved apparatus for storing moving printing belts within a belt-type printing machine with multiple printing stations for processing a single web; to reduce the lateral oscillation of belts moving at high linear printing speeds; to provide belt-supporting structure of improved belt tracking capability; to provide a machine configuration which allows adequate room for operators to perform service functions around the printing stations; and other objects including provision of apparatus in accordance with the foregoing objects capable of handling a great range of lengths or printing belts.

Summary of the Invention

The invention resides essentially in a belt-type printing machine incorporating apparatus for supporting an endless printing belt in a serpentine path compacted within a box-shaped region adjacent the path of a web to be printed. Rotatable cylindrical means, such as fully cylindrical rolls or devices of the type comprising discs of cylindrical priphery mounted in fixed spaced relationship on an axle means, are located along parallel axes located in staggered relationship to form the serpentine path of consecutive reversed turns. As the belt has a nonprinting side and an opposite printing side divided into a plurality of transversely spaced rows of image areas and separated by longitudinally continuous nonprinting lands, the group of cylindrical means contacting the printing side comprise the aforementioned devices with cylindrical disc members in tracking enegagement with the lands of the nonprinting side. An extirely unexpected result of this serpentine arrangement is the improved ease with which the belt tracks over the various cylindrical devices.

A preferred embodiment also provides some of the cylindrical means defining the belt circuit arranged and located with respect to the aforementioned box-shaped region to provide a peninsular region contiguous therewith terminating distally in a plate cylinder adjacent the web path. Such an arrangement of the rolls or other cylindrical means enables a substantial portion of the periphery of the plate cylinder, e.g., 180° or more, to be engaged by the belt, thereby providing adequate belt area for inking equipment, impression roll, or any other equipment requiring rolling contact with the portion of the belt supported on the plate cylinder.

Brief Description of the Drawing

FIG. 1 is a diagrammatic illustration of a portion of a belt printing machine in accordance with the prior art.

FIG. 2 is a diagrammatic elevation of essential portions of a two-belt printing machine in accordance with the invention.

Description of the Preferred Embodiment

Figure 3:
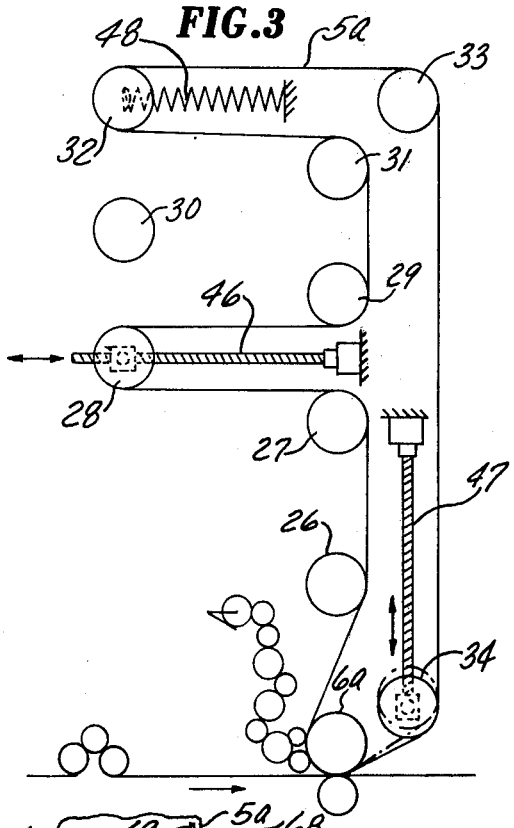
FIG. 3 is a diagrammatic elevation of a single printing belt unit illustrating the practice of by-passing portions of the belt-supporting structure in the lacing of short-length belts thereon.
Figure 4:
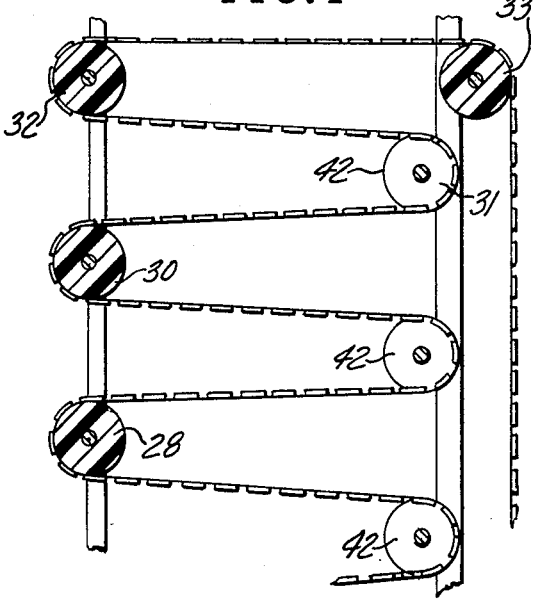
FIG. 4 is a fragmentary schematic elevation of elements of a belt-supporting unit employing different types of cylindrical means shown singly in FIG. 5.

FIG. 1 illustrates a prior art arrangement of a printing belt machine wherein a printing belt 5 advances around a driven plate roll 6, ilder rolls 7,8 and 9. The printing occurs on a web 10 at the nip of the roll 6 supported above the web path and an impression roll 11 in sub-juxtaposition to the web path. Rolls 12 comprise an ink train of which two rolls are observed in rolling contact with the plate roll 6. The circuit of the belt 5 may be lengthened or shortened by operation of a screw device 14 operating on bearing blocks of rolls 9 and 8 to appropriately adjust the circuit length of the machine for different length belts. An apparatus typifying the arrangement of FIG. 1 and, in general, the present state of the art, is described in much detail in Stroud et al U.S. Pat. No. 3,518,940.

The other figures of the drawings illustrate the invention and relate to a belt supporting structure which achieves a greater utilization of space necessitated in the building of more complex, e.g., multicolor belt-type printing machines, while utilizing the principals of operation disclosed in the simpler machine of U.S. Pat. No. 3,518,940. FIG. 2, for example, discloses that a web 20 originating in a supply roll 21 passes through two printing stations established by the nips of impression rolls 11*a* and 11*b* with respective belts 5*a* and 5*b* supported against the transfer rolls by plate rolls 6*a*,6*b*, respectively. FIG. 2 illustrates two-belt tracking systems 24,25, which comprise, in addition to respective plate rolls 6*a*,6*b*, and various nondriven idler rolls 26 to 34 inclusive.

Figure 5:
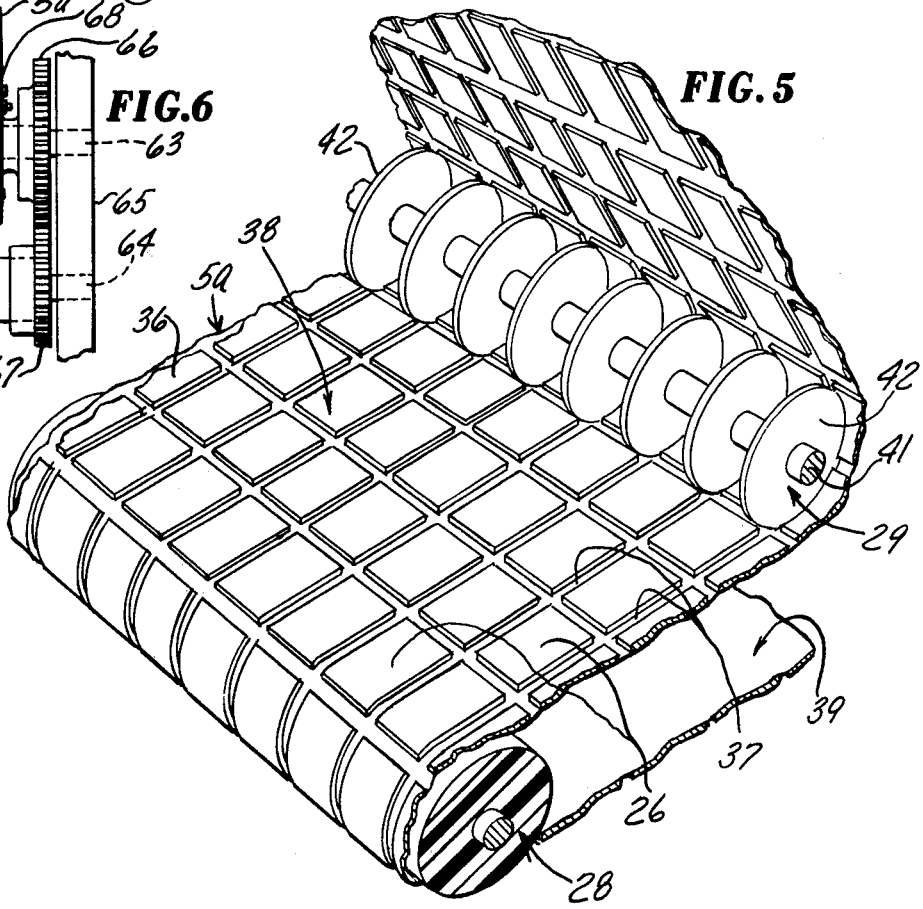
FIG. 5 is a fragmentary perspective view illustrating an extension of a printing belt around two types of rotatable cylindrical belt support rolls.

Obvious from the drawing is that rolls 6*a*, 28, 30, 32, 33, and 34 engage the nonprinting or inner side of the belt 5*a*. A similar situation is true with respect to belt 5*b*. The printing side of belt 5*a* or 5*b* is engaged by rolls 26, 27, 29, and 31. The printing side of the belt is plainly portrayed in FIG. 5 wherein its surface is arranged into longitudinal rows of printing areas covered by flexible printing plates 36 typically of plastic or rubber-like material separated by longitudinally extending lands 37. The lands and the printing areas comprise the printing side 38 of the belt. Also shown in FIG. 5 is the normally smooth nonprinting side 39 of the belt. It will be noted that roll 29, typical of one of the rolls which contact the printing side of the belt, comprises shaft means 41 and a plurality of cylindrical discs 42. The discs are spaced lengthwise of the shaft means to track along the longitudinal lands or nonprinting areas 37 of the belt. The discs 42 are of less width than the lands so as not to interfere with printing media on the belt.

As the belt 5*b* is constituted normally of nonstretchable but flexible synthetic polymeric material, such as the polyester known under the trademark "MYLAR", the outer peripheral surfaces of the discs 42 may be formed of a similar plastic material or any material providing appropriate hardness enabling firm support of the belt but sufficiently soft to minimize belt wear.

Roll 28 is shown as having a continuous cylindrical surface for engaging the nonprinting side of the belt. Rolls 6*a* and 6*b* must, in any event, be of uninterrupted cylindrical contour in order to give the belt solid support in effecting printing as the belt and the web 20 pass through the nip of the plate roll and the transfer roll. However, except for rolls 6*a*,6*b*, experience has shown that it may be possible to employ the other rolls which contact the nonprinting surface 39, and rolls which are similar in construction to the multiple disc roll 29.

In the operation of printing machines, such as described herein and in U.S. Pat. No. 3,518,940, it is important to be able to accommodate the belt tracking systems to belts which differ greatly in length, for example, from 5 to 75 feet. In FIG. 3, the belt is shown as by-passing idler roll 30. When the tracking assembly is of the order of 6 feet in width, to establish such a by-pass means, it has the effect of accommodating the system to a belt of perhaps 10 or 12 feet shorter in length. However, the system also has to provide for adjustability of increments less than the large increment effected by by-passing an idler roll. Roll 28, positioned within a reverse turn, is shown connected with a screw device 46 by which the roll may be adjusted in a horizontal direction toward and away from its position in the reverse turn toward and away from the rolls 27,29 to effect substantial increments of adjustment for different belt lengths and thus extend or shorten said circuit. Roll 34 is also shown connected with a screw device 47 which enables minor take-up adjustments of the belt by moving the roll 34 in a vertical direction. As the belt tracking system needs tensioning, the apparatus of one of the idler rolls may be resiliently supported against the web 5*a* in the manner for urging the roll 32 into the reverse turn of the belt as shown in FIG. 3 by a spring 48 or other resilient device.

One of the most frequent chores in tending a printing machine is the servicing of the ink train, such as ink train 51 or 52. The arrangement of a printing machine shown in FIG. 2 is of great convenience in the printing of webs to two or more color tones. While a machine in accordance with FIG. 2 has the capability of printing two tones additional tracking units similar to tracking units 24 and 25 to achieve printing of four or more tones may be readily added.

It will be noted that rolls 27 to 33 are staggered to form the serpentine path portion of the entire circuit of belts 5*a* or 5*b* within a generally box-shaped region. Rolls 33, 34, 6*a* or 6*b*, 26 and 27 form another portion of the belt circuit that is peninsular with respect to the box-shaped region just described. As tracking systems 24 and 25 are formed with respective peninsular regions in the same relationship with the box-shaped regions, i.e., and an extension of the same corresponding side of the box-shaped region, dihedral regions 55,56 are formed exteriorly of the belt circuits within which the ink trains 51,52 may be located with much space for an operator to perform service thereon and on the idler rolls of the system. The belt tracking systems may be built to maximum heights within seven feet thereby placing all portions within arm reach of operating or servicing personnel.

In the belt tracking configurations herein described, another advantage results. The peninsular arrangement of a portion of the belt circuit extending around the plate rolls 6*a*,6*b*, the belt is brought into contact with 180° or more, depending on the location of roll 34, with the plate roll. This feature of the tracking system provides a relatively large area of belt in contact with the plate roll which may be engaged by other rolls, such as the impression roll 6*a* and rolls 58,59 of the ink train 51, or 52. In designing ink trains, it is desirable to place as many ink-carrying rolls as practicable in contact with the portion of the belt supported on the plate roll. In most cases, two inking rolls are desired as a minimum but more are sometimes provided.

Figure 6:
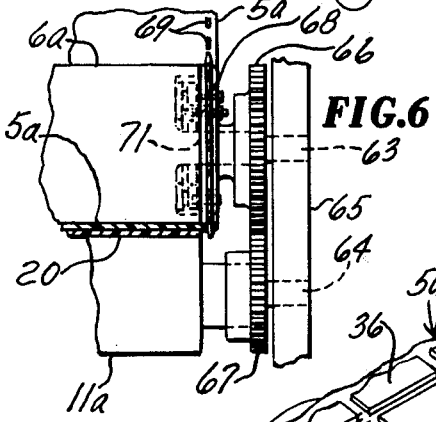
FIG. 6 is a fragmentary elevation with portions in section illustrating the drive relation of a plate roll and a transfer roll with the printing belt and the printable web therebetween.

As FIG. 2 illustrates, a common drive 62 may be used to drive the web forwarding rolls 61 and the belt advancing systems of both tracking units 24,25, and the transfer rolls 11*a*,11*b*, for the purpose of having accurate synchronization of the belt and web speeds. As schematically shown in FIG. 6, power transmission from the transfer roll to the adjacent plate roll 6*a* and hence to the belt 5*a*, as shown in FIG. 2, drive is transmitted to transfer rolls 11*a*,11*b*, through the common drive system 62. Rolls 6*a*,11*a*, are mounted on shafts 63,64, suitably bearinged in a frame member 65, gears 66,67 mounted on shafts 63,64, respectively, have pitch diameters corresponding to the diameters of rolls 6*a*,11*a*, respectively, for identical peripheral speeds. The idler rolls of each belt tracking system are supported on high grade anti-friction bearings to enable the belt to be driven solely by positive belt-driving means, e.g., by way of a sprocket gear 68 in mesh with longitudinally-spaced sprocket-teeth receiving apertures 69 in an edge portion of the belt 5*a* or 5*b*. The sprocket gear 68 is relatively rotatable with respect to the plate roll through a clutch 71 in a manner such as that described in U.S. Pat. No. 3,518,940 which disclosed that similar sprocket and clutch mechanism is provided at the opposite ends of the rolls *6a,6b* for meshing with opposite edges of the belt. It was discovered in the development of the machine of the aforenamed patent, that relative movement, such as permitted under frictional restriction of the two clutches was needed between the sprocket drive for the belt and the portion of the roll between the sprocket drive to maintain the belt in proper registry with the sprockets at high printing speeds.

What is claimed is:

1. A belt printing machine which is especially adapted for multi-tone printing on a single web and has a plurality of horizontally spaced printing stations spaced progressively along a substantially horizontal path which the web travels through the machine, comprising:

an impression cylinder disposed at each station vertically below said path;

a plate cylinder disposed in close proximity to each impression cylinder and vertically spaced above said path;

a separate printing belt for each station comprising a continuous flexible belt of non-stretchable synthetic polymeric material reeved at least partially around each plate cylinder and extending therefrom, each belt carrying a plurality of printing plates for printing on the web as it passes between the impression cylinder and plate cylinder at each station;

separate printing belt supporting apparatus at each station in overhead relation to said path and plate cylinders comprising, (i) rotatable cylindrical means supported along a plurality of parallel axes located in horizontally parallel passes of a belt of consecutively reversed turns along a portion of a complete circuit for its respective belt within a box-shaped region spaced vertically above said path and plate cylinders, and (ii) other rotatable cylindrical means supported along a plurality of parallel axes defining another portion of said complete circuit surrounding a peninsular region projecting substantially vertically from said box-shaped region toward said path and terminating distally at each plate cylinder, the peninsular region being located and sized relative to the box-shaped region such that a dihedral region is formed therebetween to accommodate an ink train and personnel;

positive belt-driving means in coaxial adjacent relation with said plate cylinders at opposite ends of said plate cylinders in positive drive relation with opposite edges of the belt; and common drive means for all of said belt-driving means and said impression cylinders effecting accurate synchronization of the belt speeds and the web speed.

2. The belt printing machine of claim 1 wherein:

said belt has longitudinally-spaced sprocket-teeth receiving holes in opposite edge portions; and said belt-driving means are sprocket means in meshing relation with said holes.

3. The belt printing machine of claim 1 wherein:

said peninsular regions extend toward said web path substantially as an in-line extension of corresponding sides of the box-shaped regions.

4. The belt printing machine of claim 1 comprising:

a train of inking rolls in each dihedral region;

said cylindrical means being arranged in each peninsular region to cause a belt passing thereover to envelop at least a 180° portion of the periphery of the respective plate cylinder of that region; and at least two rolls of the respective adjacent inking roll train in engagement with that portion of the belt extending over the enveloped peripheral portion of the plate roll.

* * * * *